US009939171B2

(12) United States Patent
Lollar et al.

(10) Patent No.: US 9,939,171 B2
(45) Date of Patent: Apr. 10, 2018

(54) UNIVERSAL ELECTRIC DUCT HEATER AND METHOD OF USE

(71) Applicant: TUTCO, INC., Cookeville, TN (US)

(72) Inventors: James Patrick Lollar, Cookeville, TN (US); Devin Ridley, Cookeville, TN (US)

(73) Assignee: TUTCO, INC., Cookeville, TN (US)

( * ) Notice: Subject to any disclaimer, the term of this patent is extended or adjusted under 35 U.S.C. 154(b) by 760 days.

(21) Appl. No.: 14/159,434

(22) Filed: Jan. 20, 2014

(65) Prior Publication Data

US 2014/0205271 A1 Jul. 24, 2014

Related U.S. Application Data

(60) Provisional application No. 61/754,183, filed on Jan. 18, 2013.

(51) Int. Cl.

| | |
|---|---|
| ***H05B 3/16*** | (2006.01) |
| ***F24H 3/04*** | (2006.01) |
| ***F24H 9/20*** | (2006.01) |

(52) U.S. Cl.
CPC ..... *F24H 3/0411* (2013.01); *F24H 9/2071* (2013.01)

(58) Field of Classification Search
CPC ..... F24H 3/0411; H05B 3/16; H05B 3/32
USPC ..... 219/532, 536, 541; 392/350, 360
See application file for complete search history.

(56) References Cited

U.S. PATENT DOCUMENTS

| | | | | |
|---|---|---|---|---|
| 2,614,202 A | | 10/1952 | Otto | |
| 3,102,185 A | * | 8/1963 | Boyd | F24D 5/08 219/513 |
| 3,440,400 A | * | 4/1969 | Cotts | F24H 3/0405 165/74 |
| 3,622,752 A | * | 11/1971 | Brasch | F24H 3/0405 219/532 |
| 3,631,525 A | * | 12/1971 | Brasch | F24H 3/0405 219/532 |
| 3,669,349 A | * | 6/1972 | Hall, Jr. | F24F 3/048 165/214 |
| 3,794,810 A | * | 2/1974 | Brasch | H05B 3/06 219/532 |
| 4,268,742 A | | 5/1981 | Cottrell et al. | |
| 4,706,736 A | * | 11/1987 | Gyori | F24H 9/2071 165/206 |
| 4,710,610 A | * | 12/1987 | Reifel | F24H 3/0411 219/532 |

(Continued)

FOREIGN PATENT DOCUMENTS

| | | |
|---|---|---|
| CN | 1782611 | 6/2006 |
| CN | 202133119 | 2/2012 |
| CN | 202371876 | 8/2012 |

*Primary Examiner* — Dana Ross
*Assistant Examiner* — Lawrence Samuels
(74) *Attorney, Agent, or Firm* — Clark & Brody

(57) ABSTRACT

A duct heater has a unique and symmetric arrangement of an auto limit and a pair of back up limits to permit the duct heater to be mounted in a duct in a number of different orientations. The duct heater can include a diffuser screen and have a particular size with respect to an upstream piece of equipment such as a single duct variable air volume damper box so that it can be used in these types of applications as well as stand alone applications in a duct.

13 Claims, 13 Drawing Sheets

(56) References Cited

U.S. PATENT DOCUMENTS

| | | | | | |
|---|---|---|---|---|---|
| 4,837,547 | A * | 6/1989 | Nixon | H01H 37/76 | 337/398 |
| 5,471,034 | A * | 11/1995 | Kawate | B60H 1/2225 | 219/483 |
| 6,593,554 | B2 * | 7/2003 | Danko | F24H 9/2064 | 219/532 |
| 7,012,223 | B2 * | 3/2006 | Kopel | F24H 9/2071 | 219/483 |
| 7,149,416 | B2 * | 12/2006 | Nawrot | F24H 3/0405 | 219/536 |
| 7,154,072 | B2 * | 12/2006 | Sherrill | H05B 3/16 | 219/478 |
| 2003/0015146 | A1 * | 1/2003 | Hawks | F24H 3/0411 | 119/448 |
| 2005/0109764 | A1 * | 5/2005 | Kopel | F24H 9/2071 | 219/494 |
| 2006/0118545 | A1 * | 6/2006 | Sherrill | H05B 3/16 | 219/532 |
| 2009/0114732 | A1 * | 5/2009 | Hawkins | F24D 5/12 | 237/12 |
| 2010/0326624 | A1 * | 12/2010 | Hancock | F24F 3/0442 | 165/47 |
| 2011/0002672 | A1 * | 1/2011 | Krapp | F24H 3/0411 | 392/360 |
| 2012/0055914 | A1 * | 3/2012 | Goto | B60N 2/5685 | 219/217 |

* cited by examiner

BOTTOM MOUNT SLIP-IN CONSTRUCTION

Round Inlet Restriction:

X Min. = 0.0"
Y Max. = 2.0"

Y Min. = 0.0"
Y Max. = 4.0"

Duct Sizes:

H = (2)X + Dia.
W = (2)Y + Dia.

H Min = (2)0.0 + Dia.
= Dia.
H Max = (2)2.0 + Dia.
= 4.0 + Dia.

W Min = (2)0.0 + Dia.
= Dia.
W Max = (2)4.0 + Dia.
= 8.0 + Dia.

Square or Rectangle Inlet Restriction:

X Min. = 0.0"
X Max. = 2.0"

Y Min. = 0.0"
Y Max. = 8.0"

Duct Sizes:

H = (2)X + Hr
W = (2)Y + Wr

H Min = (2)0.0 + Hr.
= Hr
H Max = (2)2.0 + Hr
= 4.0 + Hr

W Min = (2)0.0 + Wr
= Wr
W Max = (2)8.0 + Wr
= 16.0 + Wr

Oval Inlet Restriction:

X Min. = 0.0"
X Max. = 2.0"

Y Min. = 0.0"
Y Max. = 4.0"

Duct Sizes:

H = (2)X + Dy
W = (2)Y + Dx
H min = (2)0.0 + Dy
= Dy
H max = (2)2.0 + Dy
= 4.0 + Dy
W min = (2)0.0 + Dx
= Dx
W max = (2)4.0 + Dx
= 8.0 + Dx Obround Inlet Restriction:

X Min. = 0.0"
X Max. = 2.0"

Y Min. = 0.0"
Y Max. = 6.0"

Duct Sizes:

H = (2)X + Dy
W = (2)Y + Dx
H min = (2)0.0 + Dy
= Dy
H max = (2)2.0 + Dy
= 4.0 + Dy
W min = (2)0.0 + Dx
= Dx
W max = (2)6.0 + Dx
= 12.0 + Dx

UNIVERSAL ELECTRIC DUCT HEATER AND METHOD OF USE

This application claims priority under 35 USC 119(e) based on provisional application No. 61/754,183, filed on Jan. 18, 2013.

FIELD OF THE INVENTION

The invention relates to an electric duct heater that has universal installation capabilities as well as the ability to be used in both standard type duct heating applications and duct heating applications involving equipment such as valves or duct transitions.

BACKGROUND ART

Electric duct heaters are well known for use in heating air which can be supplied to rooms or spaces through HVAC ducts. The design of these duct heaters is well known and they have been built for many years. They are also regulated for safety performance through UL Standard UL1996. This UL1996 standard is a very stringent standard for practices and evaluation and relates to the placement of duct heaters at a particular spacing from equipment, structure or the like that is part of or related to the duct containing the electric heater.

Another standard for electric heater applications is UL 1995. This standard controls the electric heater design when it is incorporated into a piece of equipment or other structure that would be near the heater. An example of such a heater would be the heater found in conventional ducted packaged terminal air conditioner (PTAC) units or typical residential HVAC systems. These types of heaters do not necessarily involve the placement of the heater in a duct so that the standards controlling the design for these types of equipment heaters are different than electric duct heaters.

What this means is that not all duct heaters have application as equipment heaters and not all equipment heaters have application for duct heating.

Most present day duct heaters are built with safety limit controls. FIG. 1*a* shows an example of a typical construction for a duct heater 100 and the limit controls that the heater employs and that uses a one phase layout and one heater coil 102. The limit controls are devices that when heated to a certain point will turn off power to the heater to prevent over temperature or safety problems.

An auto limit 101 will open to turn power off at specified temperatures and automatically close when cooled to some lower temperature, allowing the heater to restart if needed. A backup limit 103 can typically be a one-shot device, meaning this device opens at a specified temperature and does not close again, forcing a technician to replace the device to repair the heater. Also, the backup limit 103 can be a manually-resettable device that opens and can be manually reset by pushing a reset button (typically located on the device) to re-establish power and return the heater to operational status, as needed.

Still referring to FIG. 1*a*, it should be noticed that the backup limit 103 is typically located toward the top 105 of the heater. The reason for this is that since heat rises, this should be the hottest point in connection with this heating unit if air supply is limited or no airflow exists.

The backup limit 103 is typically set at a higher temperature than the auto limit 101 for cut-oft the idea being the auto limit 101 can open and close at a lower temperature range to keep air supply temperatures lower (if needed), and the higher temperature target of the backup limit 103 would function if the temperature continued to rise for some reason, or if the auto limit 101 fails to function properly, etc.

As shown in FIG. 1*b*, because of the arrangement of the back up limit 103 and auto limit 101 in the prior art heater 100, flipping the duct heater to accommodate a different installation orientation results in the back up limit 103 being on the bottom 107 of the heater 100, which would be normally cooler than the top 105 of the heater. Thus, this type of heater cannot be used in different orientations and still maintain a safe operation of the heater, particularly with respect to the backup limit functionality.

In order to maintain the functionality of the duct heater for different installations, differently designed duct heaters must be used. This is shown in FIG. 2. As can be seen in FIG. 2, the heater assembly 200 considered as a "left hand" heater is built with the box overhang 201 to the left of the heater 203 (when viewed from the front of the box).

FIG. 2 also shows a heater assembly 205 considered as a "right hand" heater with an overhang 206, which is designed to be inserted into the duct 207 on the side opposite that of the "left hand" heater assembly 200. The backup limit location for heater assembly 200 is at 209 and the backup limit location for the heater assembly 205 is at 211. In order for the backup limit to be located in its desired location, i.e., near the top location, as in the case of the "left hand" heater assembly 200, an entirely different heater must be built if the heater is to be mounted on the other side of the duct, thus the "right hand" design. This is consistent with the state of the prior art, wherein most duct heaters are designated and/or requested as "right" or "left" handed. They are not symmetrical and therefore not flippable in a given installation site.

This also becomes a problem if the installer does not realize the direction of air flow in the duct. Specifying a "left hand" duct heater may not work when the installer realizes that the air is flowing in the opposite direction to his/her understanding and this is affecting duct mounting location, access, or special limitations.

Thus, a need has developed to provide improved heater designs that lead away from the requirement of different heaters for different types of installations or installation characteristics. The present invention is directed to solving this problem.

Another problem with duct heaters is that they are not readily adapted or co-adapted for use for applications that would be required to meet UL 1995 standards and without additional testing. The invention is also directed to this problem and produces a heater design that can be used to meet either UL 1996 or 1995 standards.

SUMMARY OF THE INVENTION

This inventive heater, in one mode, is designed and constructed such that regardless of orientation for a horizontally or vertically installed heater, the function during normal and abnormal operation would be the same. This is principally due to a centrally located automatic over temperature thermostat and the heater element symmetry in relation to this thermostat, regardless of the thermostats temperature setting or type.

Additionally, the design is such that the back up protection thermostat is wired in series either in the control voltage or line voltage circuit, either vertically or horizontally on the same axis as the automatic thermostat, to replicate the same symmetry and further allow for proper function of backup protection regardless of installed orientation.

This inventive heater design allows horizontally and vertically installed units (that are not otherwise sensitive to installation orientation) to be rotated or flipped 180 degrees without change in function or safe operation. The design also means that the end user can flip or rotate the duct heater by 180 degrees without being concerned about the direction of airflow. The advantage here is that the end installer can flip or rotate the heater to fit the area available on a particular job site and can additionally be confident the airflow direction will not be of concern. So, a single heater is provided for mounting in the side of horizontal or vertical ducts and a single heater is provided for mounting in the top or bottom of horizontal ducts.

Another aspect of the invention is the combination of the unique symmetry design with specific flow control screens having an open percentage in the range of 51% to 67%. These screens or diffusers serve not only to shield surrounding components and materials from radiant energy, but also to evenly distribute air flowing through the heater. This combination results in the ability of an electric heater capable of being used as a stand alone duct heater to be employed as well in an application such as with a single duct variable air volume (VAV) heating system, which may involve a different standard as compared to a stand alone duct heater.

When using the inventive design as part of a single duct VAV heating system, a sizing is performed that relates the restricted inlet and duct size downstream from the inlet so that the duct heater functions in a proper manner. This sizing involves a calculation to determine the downstream duct size limits for a given inlet. Since single duct dampers essentially consist of a shape restriction upstream from the heater, the heater is typically larger than the valve body. The calculation for a range of applicable heater sizes as a function of valve body (shape & size) or restricted inlet is unique to the inventive design and method. This sizing is both applicable for stand alone duct heaters that are positioned with some type of inlet restrictions and single duct heaters with restrictive valve body sizes and shapes that necessarily present a restricted inlet as compared to the duct size of the duct heater.

DETAILED DESCRIPTION OF THE INVENTION

Figure 1A:
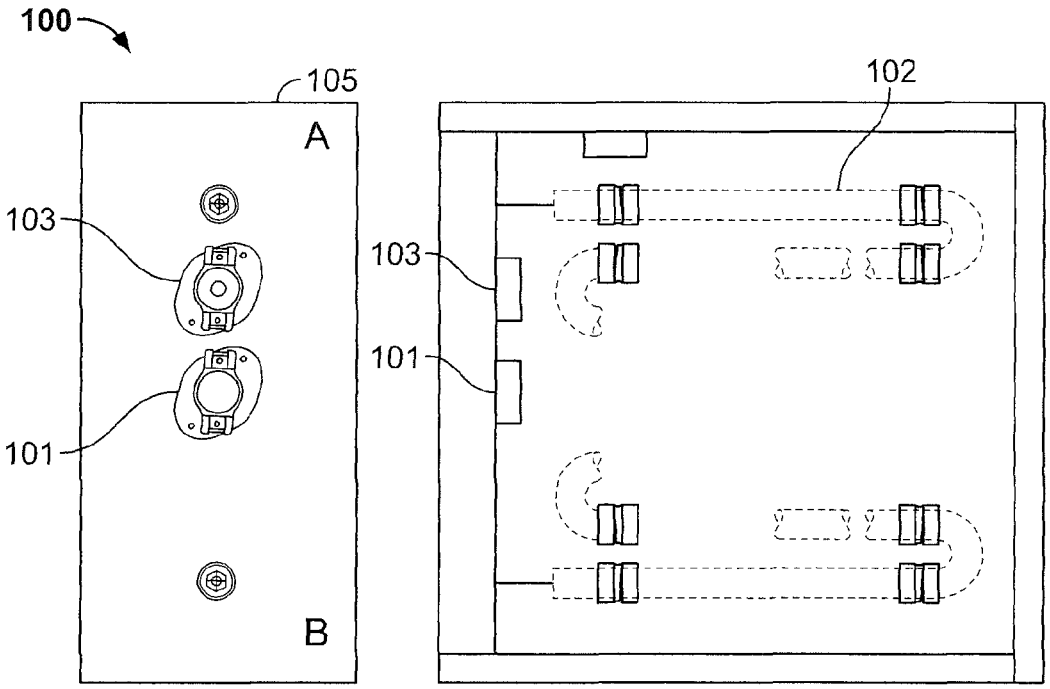
FIG. 1A (Prior Art)
FIG. 1*a* shows a prior art heater.
Figure 1B:
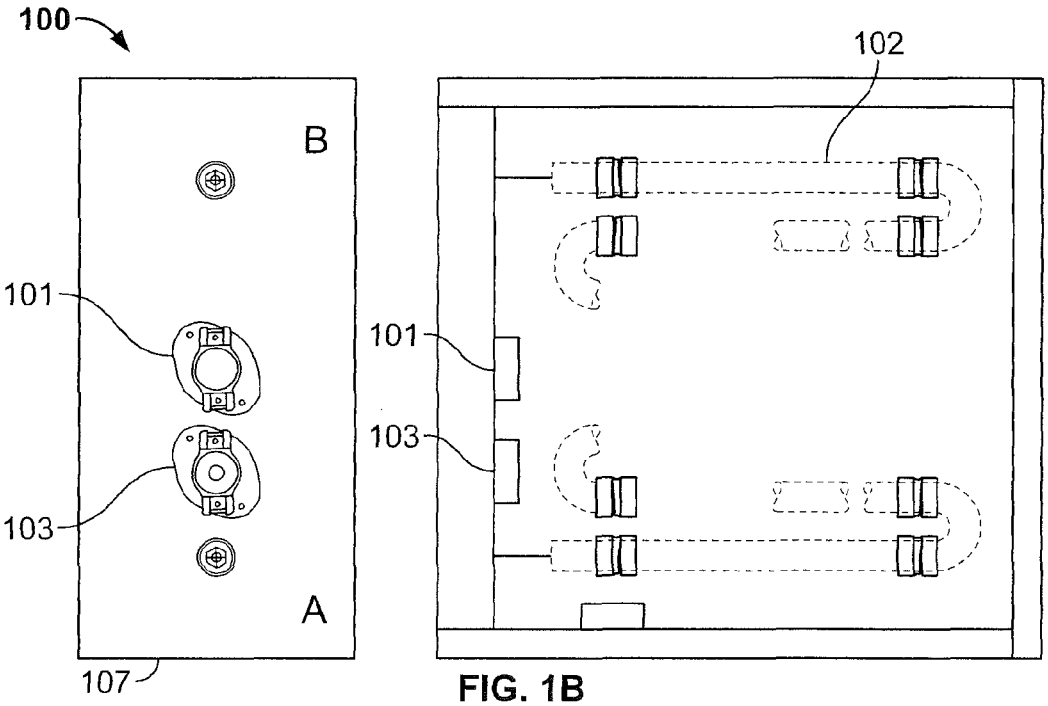
FIG. 1B (Prior Art)
FIG. 1*b* shows the heater of FIG. 1*a* in a 180 degree flipped position.
Figure 2:
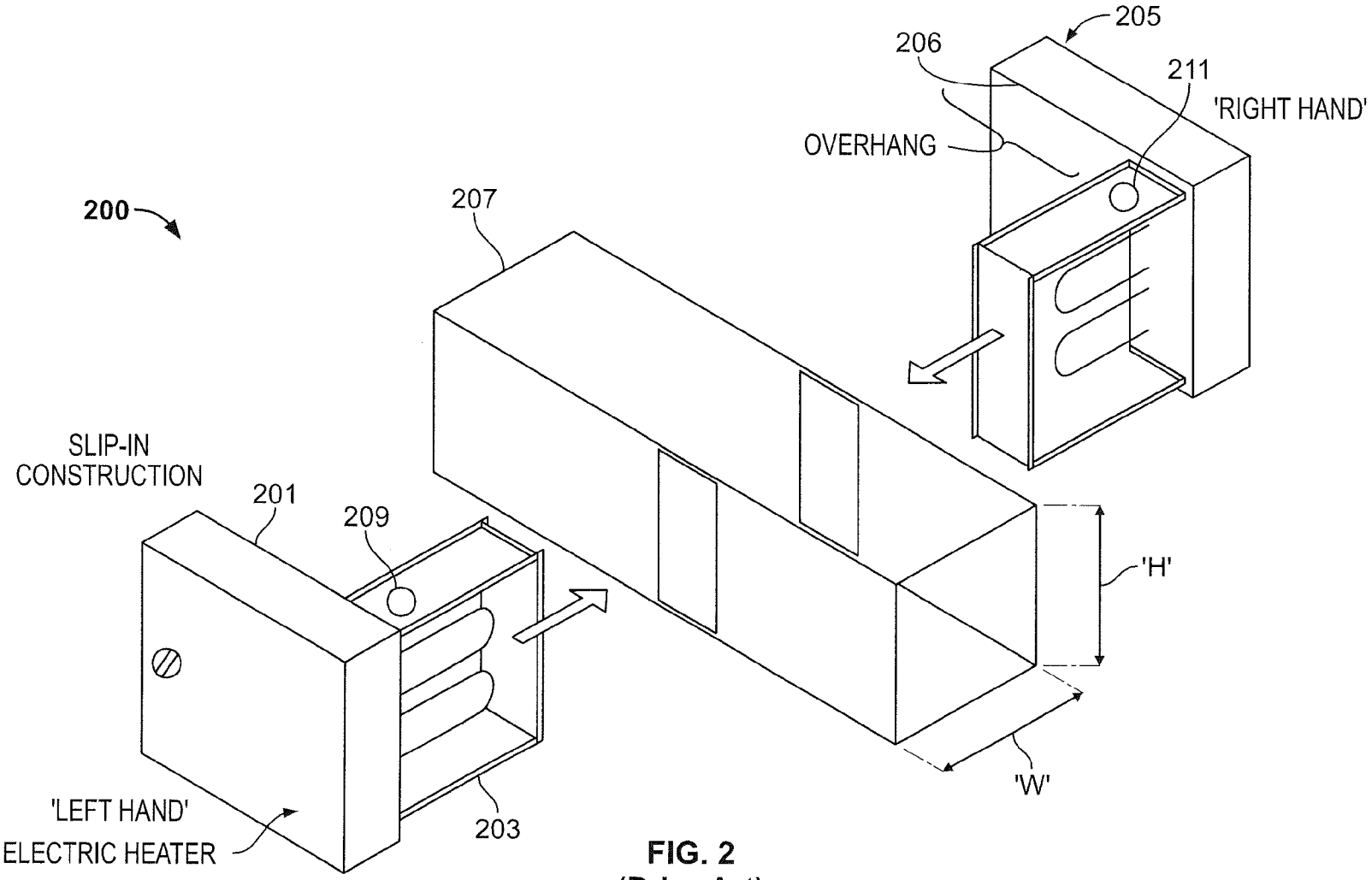
FIG. 2 (Prior Art)
FIG. 2 shows left and right handed heaters for duct installation.
Figure 3A:
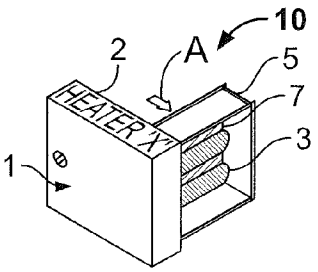
FIG. 3*a* shows a perspective view of one embodiment of a duct heater assembly of the invention.

One embodiment of the invention is shown in FIGS. 3*a* and 4. This embodiment is directed to a duct heater having an integrated symmetry so that the same duct heater can have applications in a number of different orientations. This is a significant advantage over the state of the art since there are no prior art heaters available that do away with the "right hand" and "left hand" heater constructions.

As will be described below, another embodiment of the invention takes the integrated symmetry of the inventive heater design, which is readily usable as a heater for a supply duct under, for example, UL 1996, and further develops a heater for use in an application such as a single duct variable air volume (VAV) damper box, which would be required to satisfy a different standard, likely, UL 1995. Therefore, you have one product that can be used as both a "duct heater" and a "single duct VAV heater".

FIG. 3*a* shows a universal duct heater assembly 10 that can be used in any number of different orientations. The assembly 10 includes a heater housing 1, and overhang portion 2, heater coil 3, heater coil housing 5, and a diffuser screen 7, the diffuser screen 7 positioned on the upstream side of the housing 5. The arrow A indicates the flow direction of air or other fluid passing through the housing 5 and across the coil 3.

Figure 3C:
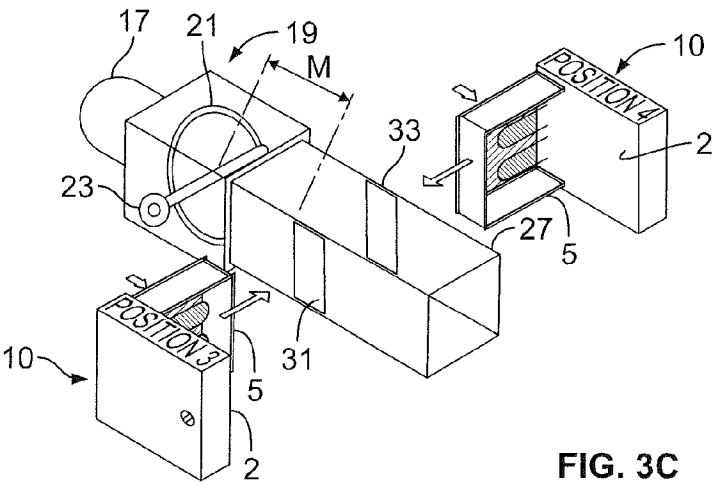
FIG. 3*c* shows a heater assembly and duct arrangement with the heaters of FIG. 3*a* in different positions.
Figure 3B:
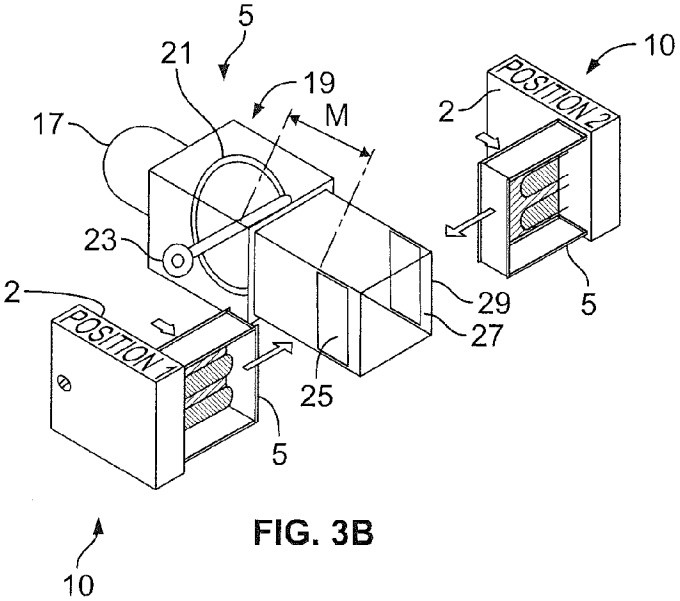
FIG. 3*b* shows a heater assembly and duct arrangement for a first embodiment of the invention.

FIG. 3*b* shows the heater assembly 10 in use as a single duct VAV heater assembly 15, which has an inlet 17, a damper box 19, with a valve 21 therein, that is linked to an actuator control (not shown) at 23. The heater assembly 10 could also be employed just as a stand alone duct heater as detailed below, i.e., without the damper box 19. FIG. 3*a* shows the heater assembly 10 in alternative positions 1 and 2. In position 1, the assembly 10 is designed to have the coil housing 5 be inserted into the opening 25 of duct 27. Position 2 shows the same heater assembly 10 flipped 180 degrees for insertion into the opening 29.

FIG. 3*c* shows positions 3 and 4. In position 3, the heater assembly shown in position 1 in FIG. 3*a* is flipped 180 degrees for insertion into the opening 31 in the duct 27. Position 4 shows the heater assembly 10 flipped 180 degrees from position 2 and also 180 degrees from position 3.

Each of FIGS. 3*b* and 3*c* show a distance M, which is the distance between the rotation axis of the valve 21 and the beginning of the openings 25 and 29 or openings 31 and 33. This distance is preferably at least 20 inches and the purpose of measuring this distance is discussed below.

The universal heater assembly 10 and its use in FIGS. 3*b* and 3*c* means that there is no need for left and right hand offset configurations as required in the prior art. Now, heater assembly 10 can be flipped and rotated to fit any number of arrangements for duct heating, including the VAV single duct arrangement shown in FIGS. 3*b* and 3*c*.

Again, it should be noted that the diffuser screen is placed on the upstream side of the coils 3. When going from position 1 to position 2, there is no need to move the diffuser screen. However, in position 3, which is a 180 degree flip from position 1, requires the diffuser screen to be moved to the other side of the coil housing 5.

Figure 4B:
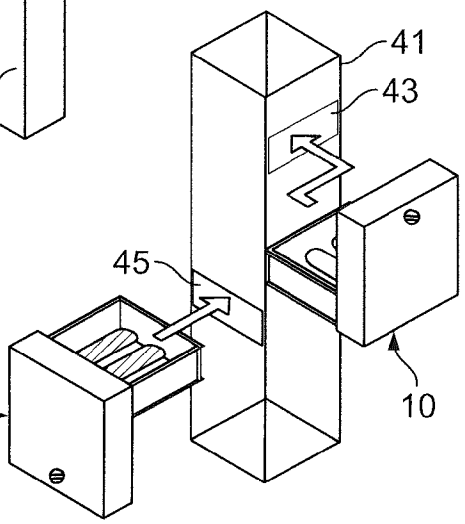
FIG. 4*b* shows a heater assembly and vertical duct arrangement.
Figure 4A:
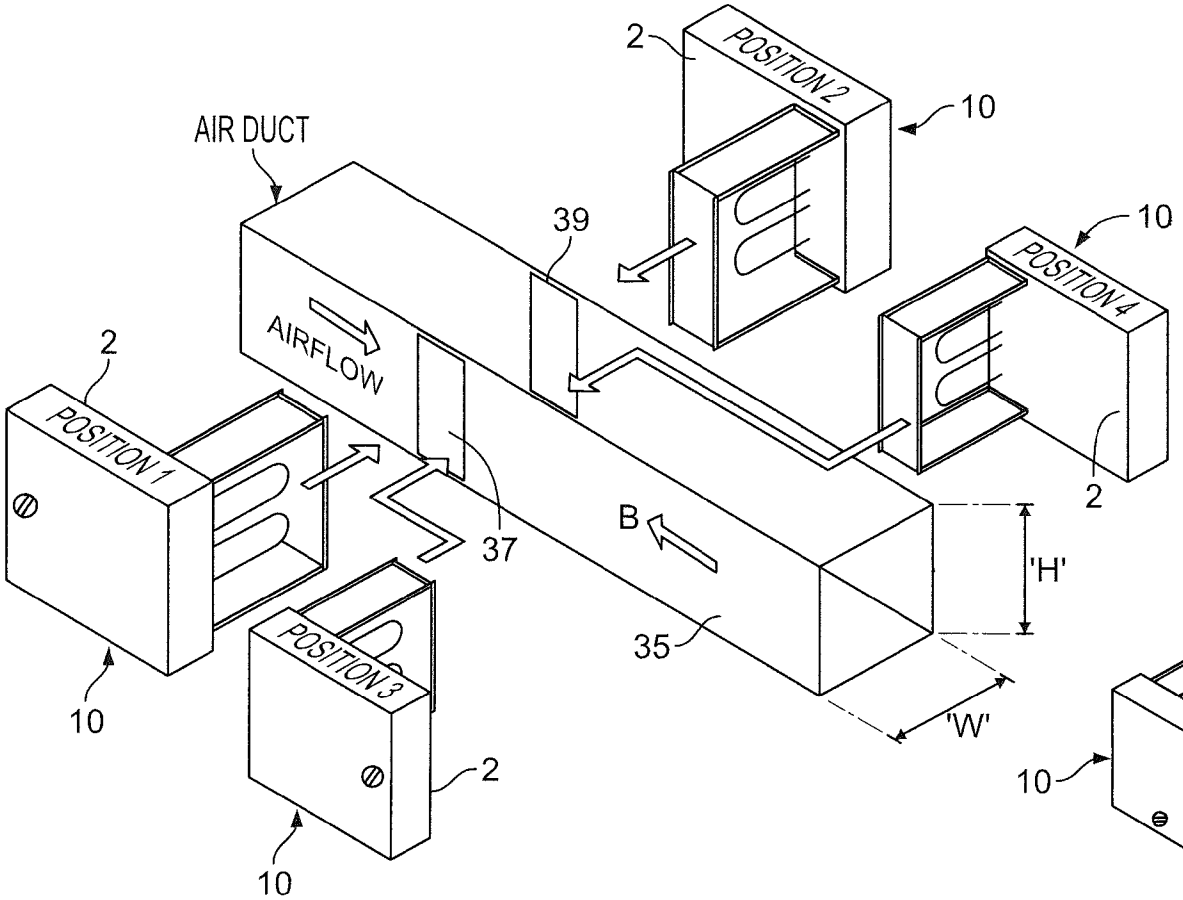
FIG. 4*a* shows a heater assembly and side horizontal duct arrangement.

FIGS. 4*a* and 4*b* show the use of the duct heater assembly in just a duct 35 of height H and width W, i.e., a stand alone application, i.e., an application that does not use the damper box 19 and inlet 17 in FIGS. 3*b* and 3*c*. The air flow is in the duct 35 is shown by arrow B. The duct heater assembly may have two (2) application sides for horizontal ducts, which are represented by the openings 37 and 39 in the horizontal duct 35. Positions 1-4 are the same as positions 1-4 in FIGS. 3*b* and 3*c*. The difference between FIGS. 3*b* and 3*c* and FIG. 4*a* is that only one opening 37 is used for position 1 and 3 and only one opening 39 is used for positions 2 and 4. This is because the valve damper box 19 is not present, which gets in the way of the heater housing 1 in positions 1 and 2 in FIG. 3*a*.

FIG. 4*b* shows a vertical duct 41 with side openings 43 and 45. The heater assembly 10 can be inserted into either opening and at different vertical heights. The vertical duct provides four (4) application sides for a vertical duct, with only two applications shown in FIG. 4*b*.

The inventive universal heater for horizontal ducts will work for four (4) mounting configurations, two different orientations for the overhang 2 for each side of the duct. For the vertical duct in FIG. 4B, two (2) configurations (orientation of the overhang) are possible for each of the four sides so that 8 total configurations are possible.

It should be understood that if mercury contactors are used in the heater construction, this will prevent the heater from being flipped upside down in certain installations and therefore the use of mercury contactors provides fewer orientations available for the inventive heater.

Figure 5C:
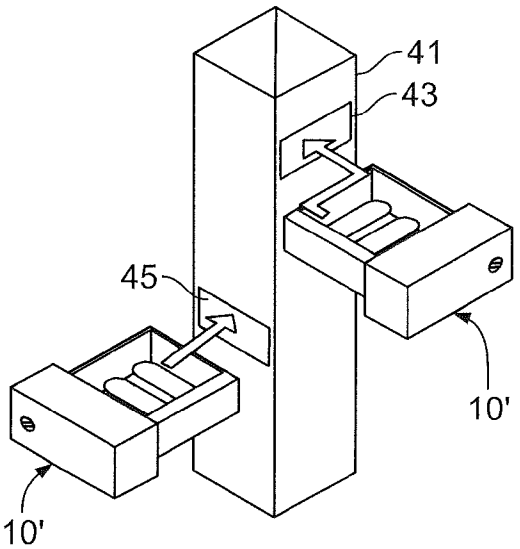
FIG. 5*c* shows an alternative heater assembly and vertical duct arrangement.
Figure 5B:
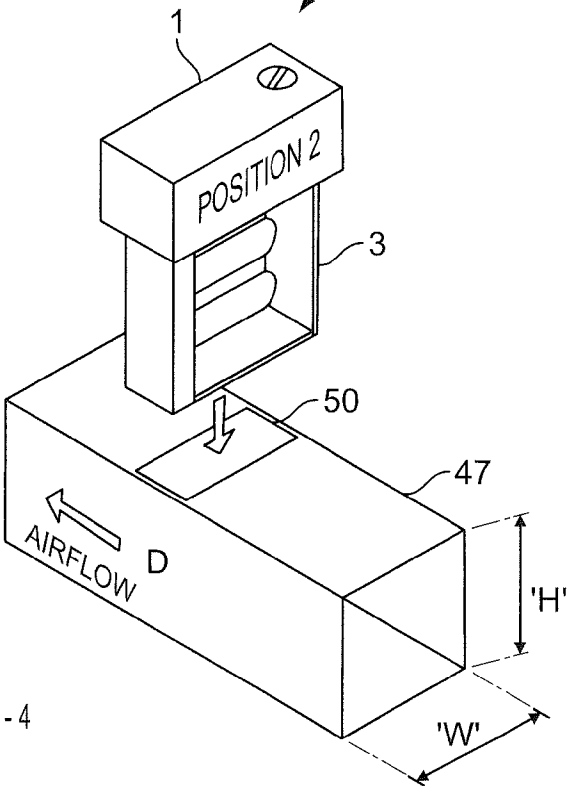
FIG. 5*b* shows an alternative heater assembly with a top horizontal arrangement and reverse flow.
Figure 5A:
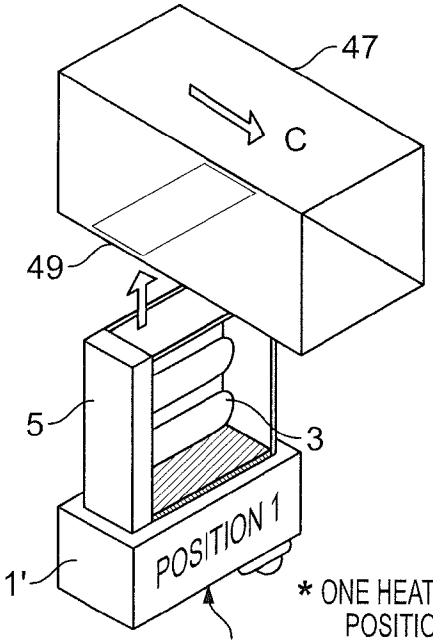
FIG. 5*a* shows an alternative heater assembly with a bottom horizontal duct arrangement.

FIGS. 5*a*-5*c* show yet another design of the universal heater assembly 10'. The assembly 10' has the same coil 3 and coil housing 5 but a modified housing 1, which does not include the overhang 2 shown in FIG. 3*a*. In FIG. 5*a*, the air flow is designated by the arrow C and the heater assembly 10' is shown mounted to the bottom of the duct 47 and in opening 49. In FIG. 5*b*, the air flow is in the opposite direction, arrow D and the heater assembly 10' is inserted in the opening 50 on the top of the duct 47. In FIGS. 5*a*-*b*, four positions are possible as a result, i.e., top or bottom mounting for the two different air flow directions. FIG. 5*c* shows a similar configuration as FIG. 4*b*. In FIG. 5*c*, the vertical duct 41 and openings 43 and 45 are shown as are the heater assembly 10' for insertion into the openings 43 or 45. In FIGS. 5*a*-*c*, the heater housing 1' is aligned with the heater, whereas in FIGS. 4*a* and 4*b*, the overhang 2 and heater housing 1 forms a right angle with the heater coils. This overhang or heater housing configuration is shown for illustrative purposes only and does not indicate any requirement or limitation.

The ability of the universal mounting or multi position mounting of the inventive heater duct is related to the configuration of the backup and auto limits. More particularly, one (1) automatic safety limit (auto limit) is provided and it is generally centrally located on a portion of the heater and central with respect to the heating elements. This allows a replication of function and performance regardless of the actual heater mounting orientation, which is described in more detail below.

Additionally, the use of one (1) automatic limit control being centrally located in a portion of the heater provides the advantage that the usage of multiple automatic limits is avoided. Having multiple auto limits is a common practice in the prior art and having these multiple units can effect the actual heater performance when the mounting orientation is varied in the field.

Another feature of the heater is the use of two (2) backup limits, which are symmetrically located with respect to the heater elements and the auto limit. With this configuration, one can utilize these same devices "electrically", i.e., in many circuit designs to have a very full kw/voltage combination offering over the entire scope of this heater's use and application in the marketplace.

Figure 6A:
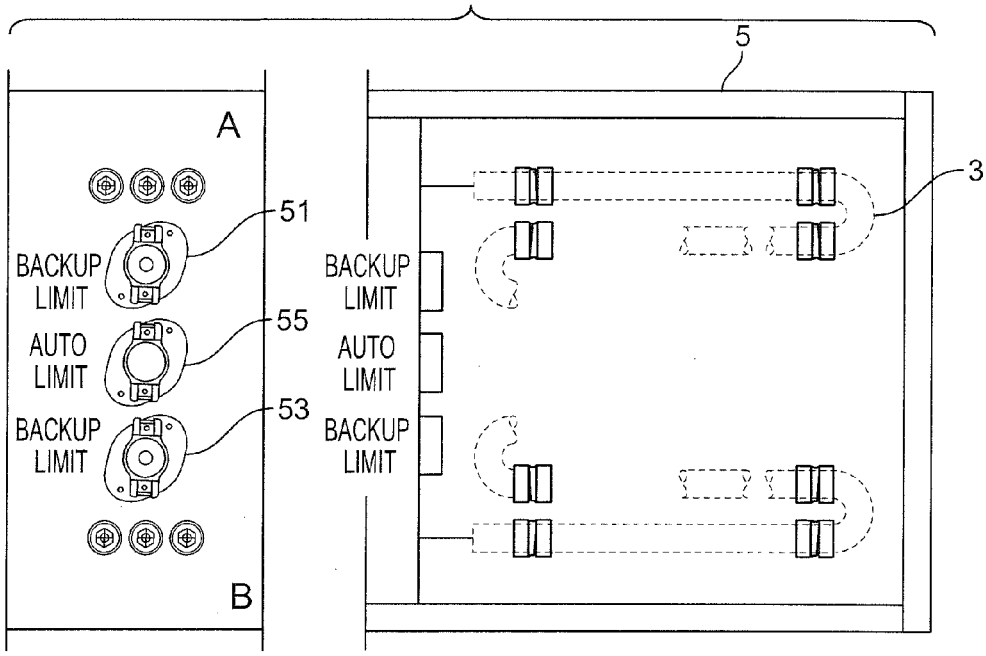
FIG. 6*a* shows an end and side view of an inventive heater assembly.
Figure 6B:
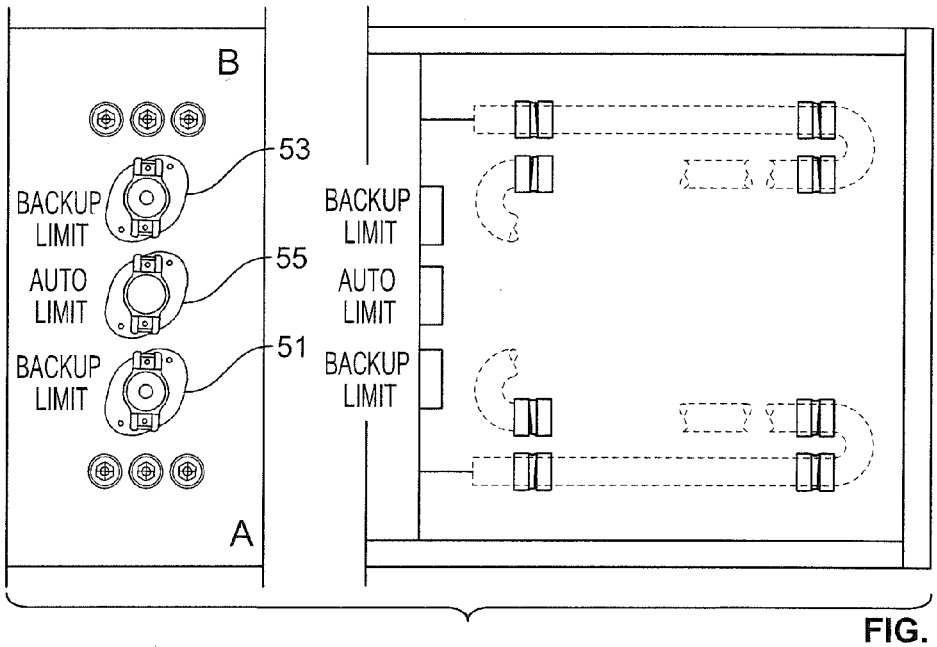
FIG. 6*b* shows the heater assembly of FIG. 6*a* in a 180 degree flipped position.

FIGS. 6*a* and 6*b* are an illustration of one embodiment of the heater assembly 10 showing a symmetry for the auto limit and backup limits that will allow the heater to be used in multiple orientations and still maintain expected performance. The backup limits 51 and 53 are positioned vertically and on either side of the auto limit 55, with all three components occupying a central location with respect to the heater elements, both from a vertical and horizontal sense. In FIG. 6*a*, the limits are basically aligned vertically with the heater elements with the auto limit 55 at a central location for the heater and the back up limits 51 and 53 equally spaced from the auto limit 55 to maintain symmetry. FIG. 6*b* shows that when the heater assembly is flipped or turned 180 degrees, the symmetry of the backup limits and auto limits is unchanged with respect to the heater elements. Therefore, the backup limits 51 and 53 are still at a location that can determine the hot spot and control the heater operation in a safe manner.

When considering that the heater elements are arranged in a given plane, vertically as shown in FIGS. 6*a*-*b*, the two backup limits 51 and 53 and one auto limit 55 are arranged vertically with this plane.

Figure 7:
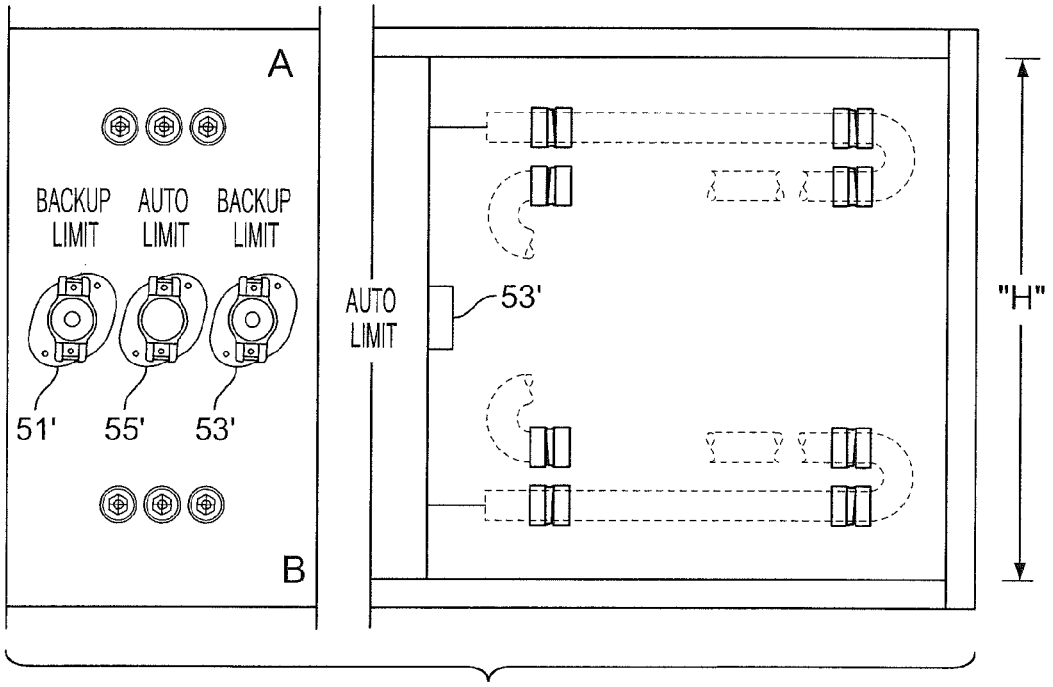
FIG. 7 shows an end and side view of yet another heater assembly.

While FIGS. 6*a*-*b* show the symmetry in a vertical fashion, FIG. 7 shows that the symmetry can also be achieved in a horizontal fashion. The arrangement of FIG. 7 provides the additional advantage of being able to make the "H" dimension shown in FIG. 7 to be smaller in order to provide a more attractive kw/voltage combination offering. Here, the backup limits 51' and 53' are still symmetrical about the auto limit 55' and its central location but their collective orientation with respect to the plane of the heater elements is perpendicular or horizontal as compared to the vertically-shown limits in FIGS. 6*a* and 6*b*.

As noted above and with respect to a second aspect of the invention, the design with its unique integrated symmetry can be used to create a "hybrid" heater that can be used in association with equipment such as single duct VAV damper boxes. Even in this use, the duct heater assembly maintains its universality wherein the heater assembly can be flipped and rotated 180 degrees allowing it to be used in most mounting positions.

In this mode, the inventive heater is really a dual use heater, whereby the heater has the ability to be used as a conventional or stand alone duct heater for installation into supply air ducting, i.e., without any interfacing or design constraints from nearby equipment or structure, and one that can be mounted in many different positions for horizontal ducts, side or top/bottom mounting, and for vertical ducts and all the vertical duct side mounting capability. Further, the dual use permits the heater to be utilized for applications involving equipment or structure, for example, restricted inlets as explained below.

Another advantage of the invention in its symmetry for the backup limits is that not only can performance be maintained (in many mounted positions), this symmetry allows for a smooth transition "for electrical usage", between single and three phase electrical systems. Advantages are also gained for the electric heat transition points for load amps and volts as well as system loads from less than 48 amps to system loads greater than 48 amps.

FIG. 13 shows a number of basic wiring schematics as examples for use with the inventive heater design. It should be understood that these are examples only, and that many other methods for wiring may be employed while still using the underlying features of the invention.

Figure 13A:
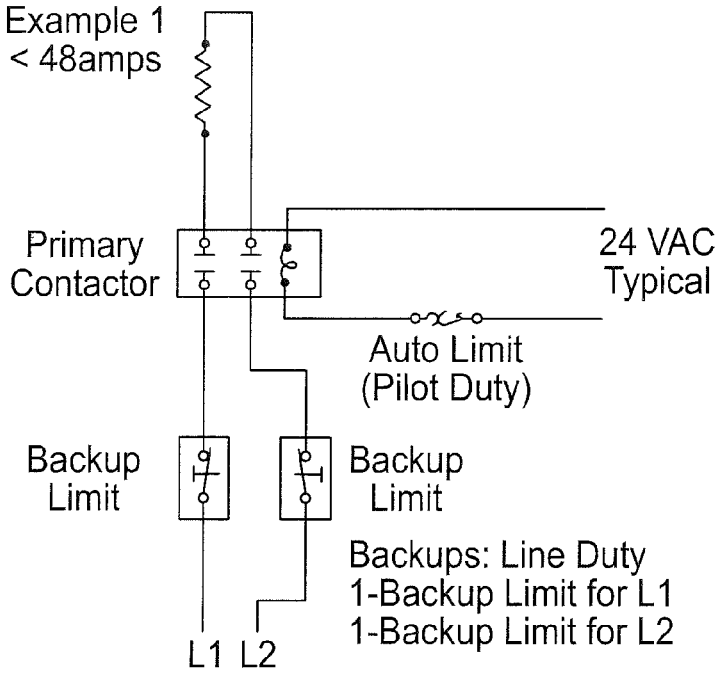
FIGS. 13*a*-13*d* show four examples of wiring schematics.
Figure 13B:
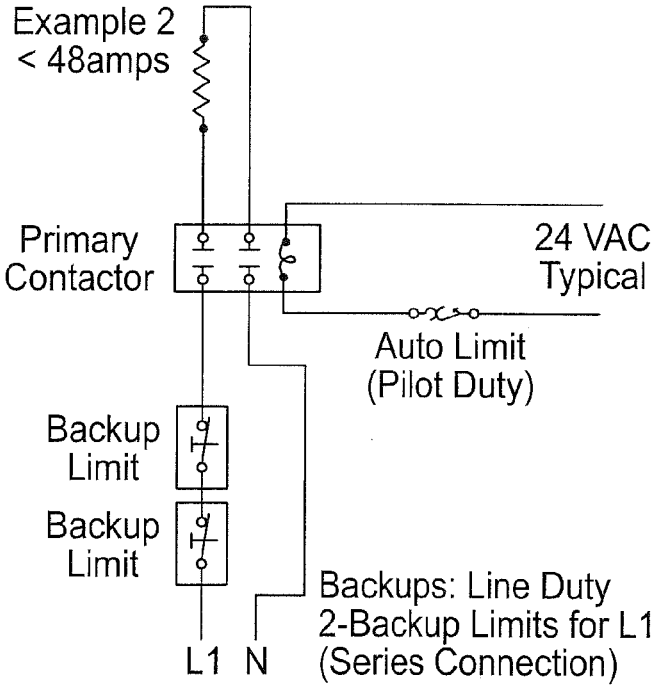
Figure 13C:
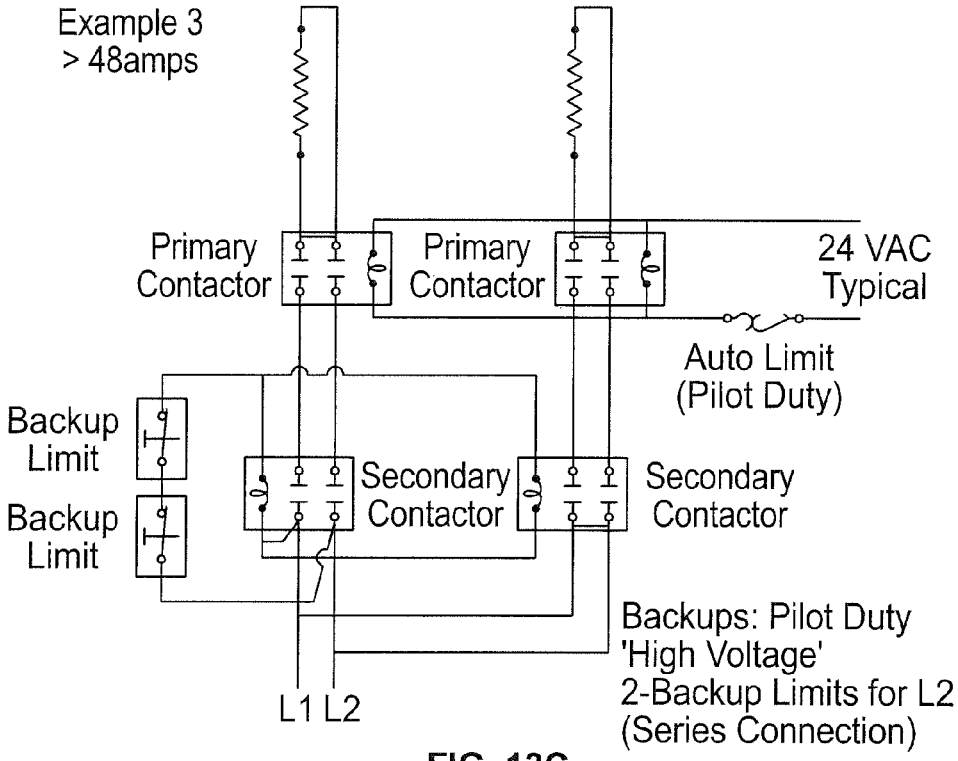
Figure 13D:
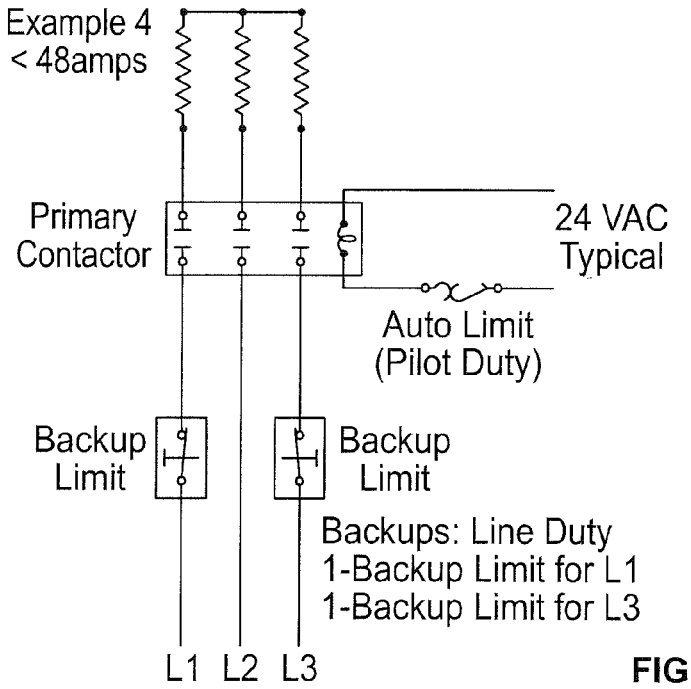

FIGS. 13*a-d* show four examples of wiring schematics with Example 1 in FIG. 13*a* showing a less than 48 amp system load and the backup limits in parallel for L1 and L2. Example 2 in FIG. 13*b* shows the same less than 48 amp system load with the backup limits in series. Example 3 in FIG. 13*c* shows a greater than 48 amp system load with a series connection and Example 4 in FIG. 13*d* shows another parallel connection for a greater than 48 amp system load.

These schematics show a single auto limit that opens the entire heater should deactivation be required.

As shown above, the use of two (2) backup limits allow the system to be symmetrical. Wiring these devices to create a safe circuit allows for the ability to build heaters to accommodate many voltages, phases and amperages. Therefore, this system allows for flippable heaters to be possible and using these devices in the quantities shown and wiring them as exemplified here and according to the skill in the art, allows heater amperages (and thus voltage/phase/and heater kw's) above and below the 48 amp sub-division point.

The second aspect of the invention will now be discussed. As mentioned above, the inventive heater with its universal design is also adapted for use in an application that would go beyond the typical stand alone heater duct installation. This second aspect encompasses applications that would likely be governed by UL 1995, wherein the heater installation has to deal with nearby structure or equipment. An example of such an application is a single duct VAV damper box, wherein a duct having the duct heater therein is linked to a restricted inlet. By restricted, it is meant that the inlet to the duct holding the heater is either the same size as the heater duct or smaller and can be restricted further by function.

As mentioned above, when a heater is closer to a piece of equipment than a specified dimension as regulated by UL standard, e.g., 48 inches in the case of UL 1996, a different standard applies to determine an acceptable arrangement between the heater and surrounding equipment as well as the heater construction itself.

According to the invention, the universal heater described above includes other features and a relationship with the restricted inlet geometry/dimensions that permits it to function properly and to industry standard as a heater in these types of applications.

The inventive and symmetric heater design is especially adapted to be used within a given distance, for example, 20 inches, from a piece of equipment/structure such as an air inlet valve body. This type of a valve body is typically the transition from a round inlet to rectangular outlet made when utilizing a single duct VAV damper box.

Referring back to FIGS. 3*b* and 3*c*, examples of these types of damper boxes and a circular restricted inlet and rectangular or square outlet, which houses the duct heater are illustrated.

The invention in this regard has two features to permit the location of the inventive duct heater in close proximity to equipment such as the valve body 21 in the damper box 19. One feature is the use of a diffuser screen 7, see FIG. 3*a*, which has multipurpose in controlling radiant energy directed to components upstream of the heater and air flow across the heater elements. Another feature is the defined relationship between the geometry/dimensions of the restricted inlet and size of the duct, which is essentially a transition between the restricted inlet and the duct housing the duct heater.

Through a progression of testing and designing during Electrical Testing Laboratory (ETL) investigations, a relationship is determined between the restricted inlet, i.e., the size of the restricted inlet, and what size the duct containing the duct heater should be for proper performance when a diffuser screen-containing heater is placed within a certain distance to the equipment in question, e.g., 20 inches from the end of a restricted inlet facing the heater, which may carry a valve for air flow control. The distance must be sufficient so that if a valve such as a baffle or flap valve is present and is fully open, the heater does not contact the edge of the valve and cause a problem in valve operation.

This relationship can be defined when considering the differences between the size of the restricted inlet dimensions and the dimensions of the duct containing the heater.

Figure 8B:
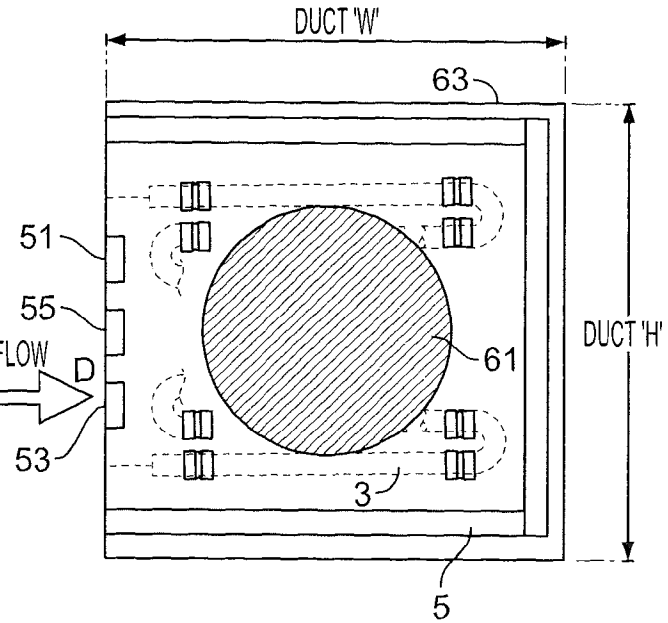
FIG. 8*b* shows an end view of the arrangement of FIG. 8*a*.
Figure 8A:
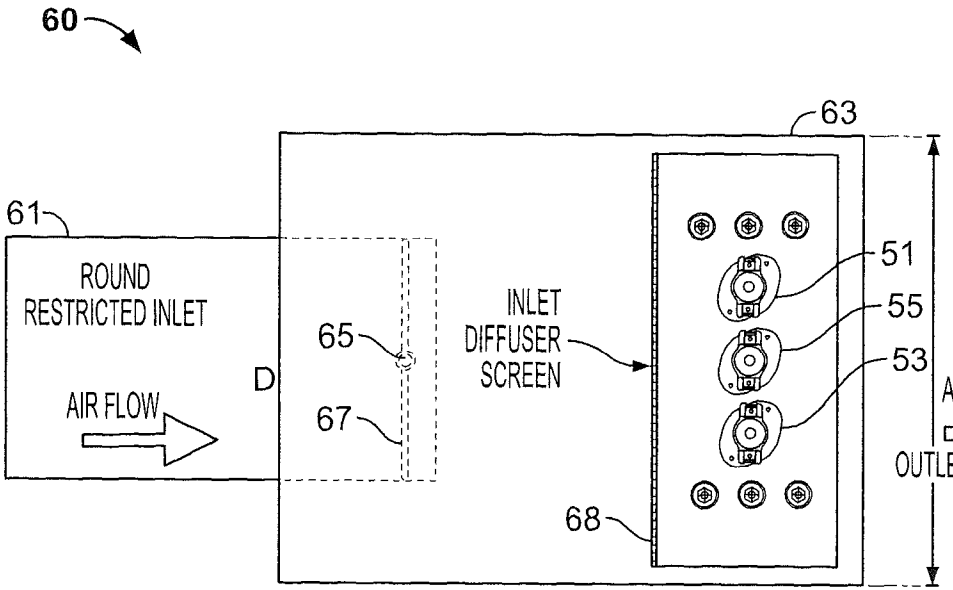
FIG. 8*a* shows a side view of a heater assembly mounted in a duct.
Figure 10:
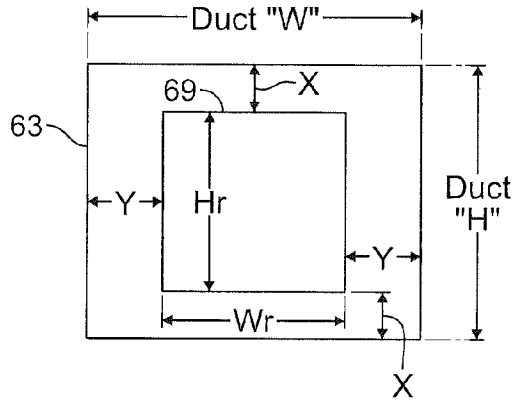
FIG. 10 shows a schematic of a square inlet and square duct and a key for sizing purposes.
Figure 11:
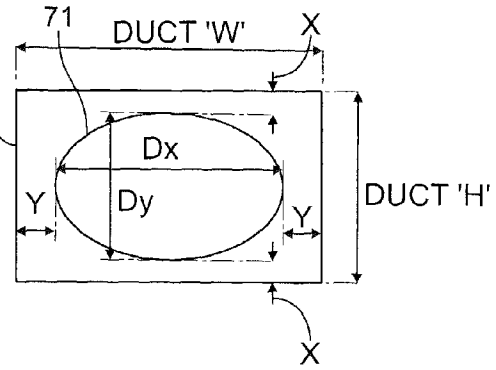
FIG. 11 shows a schematic of a first non-circular inlet and square duct and a key for sizing purposes.
Figure 12:
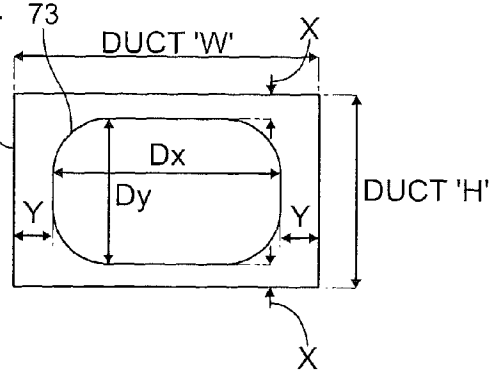
FIG. 12 shows a schematic of a second non-circular inlet and square duct and a key for sizing purposes.

FIGS. 8*a* and 8*b* show a basic layout 60 for the defined "restricted inlet" concept with air flow in the direction D. In this embodiment, the restricted inlet 61 is circular but the inlet can have other shapes as shown in FIGS. 10-12. The duct is designated by the reference numeral 63. FIG. 8*a* shows a round restricted inlet having a rotary valve 65 mounted at an end of the inlet. The pivot point 67 of the rotary valve is shown 20 inches from the heater diffuser screen 68. This 20 inch clearance allows the valve to swing full open without concern for contact with the duct heater, see FIGS. 3*b* and 3*c* for distance M. FIG. 8*b* shows the right side view of the heater assembly with the circular inlet 61 superimposed over the coil 3.

The following FIGS. 9-12 and their respective keys illustrate how the inventive heater is to be sized as it relates to the inlet restriction and the 20 inch spacing between the valve and heater.

Figure 9:
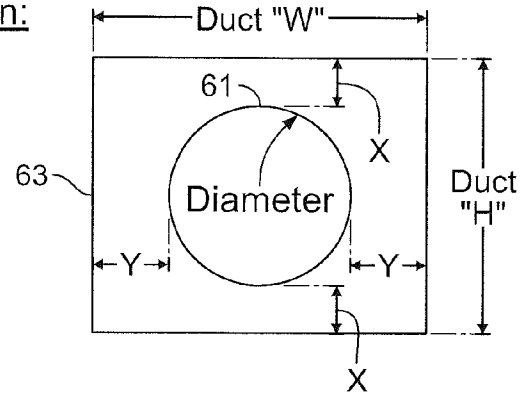
FIG. 9 shows a schematic of a circular inlet and square duct and a key for sizing purposes.

Referring to FIG. 9, one value for determining the duct size based on a restricted inlet is the differences between the duct and restricted inlet on the x axis, the vertical line through the center of the circle. This difference is noted as "x", which is the distance between each edge of the restricted inlet and the duct face spanning a width of the duct. This "x" can be no greater than 2 inches. The same distance differences are noted for y axis, wherein the values of y, which is the distance between each edge of the restricted inlet and the sides of the duct facing the edge from a height perspective.

When considering when $x_{min}$ is zero, this means that the duct cannot be smaller than the size of the inlet. For the y axis, which is the horizontal line through the center of the circle formed by the restricted inlet, the dimensions on the y axis can be no greater than 4 inches. The restriction for the x axis also applies to the y axis, that is, the duct cannot be smaller than the restricted inlet dimension on the y axis.

When considering the calculation shown in FIG. 9 using the $x_{min}$, $x_{max}$, $y_{min}$, and $y_{max}$, the dimension of the duct in terms of minimum and maximum width and height are generated. That is, the minimum height is the diameter of the inlet 61. The minimum width of the duct is similar; it is the diameter of the inlet 61. The maximum height of the duct is 4.0 inches plus the diameter of the inlet 61, and the maximum width of the duct 63 is 8.0 inches plus the diameter of the inlet 61. Put another way, the duct 63 can be no more than 8 inches greater than the diameter of the inlet 61 in width and no more than 4 inches greater than the diameter of the inlet 61 in height.

FIGS. 10-12 show other configurations of the restricted inlet and the calculations as to the limits on the duct dimensions. FIG. 10 shows a square inlet 69, FIG. 11 shows an oval inlet 71, and FIG. 12 shows an obround inlet 73. It should be noted here that a square inlet allows for a greater width of the duct as compared to a circular inlet or the other inlet shapes shown in FIGS. 11 and 12. An oval inlet/duct relationship is similar to that for a circular inlet and an obround inlet allows for a larger width dimension than the circle or oval.

When using the restricted inlet dimensions, the distances between the sides of the duct and edges of the inlet are measured at the point where the edge of the inlet is closest to the face of the duct. For the circular inlet in FIG. 8*a*, this corresponds to the horizontal and vertical lines running through the center of the circle. For the non-circular embodiments of FIGS. 11 and 12, the distances x and y are measured at the point where the two diameters $D_x$ and $D_y$ are maximum.

What FIGS. 8*a*-12 show is that the dimensions of the restricted inlet put a lower limit on the duct, in that the duct cannot be smaller in size than the inlet. The upper limit on the duct size is regulated in that it is constant from a height perspective regardless of the type of inlet; it can be up to 4.0 inches+diameter of the inlet bigger than the inlet. The width dimension of the duct is more dependent on the shape of the inlet, wherein the width can be up to 8.0 inches more than the width dimension of the inlet. In other words, the more area of the restricted inlet, the greater the duct size can be.

Figure 14A:
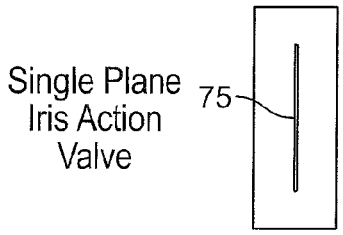
FIGS. 14*a*-14*i* show different examples of air limiting/metering valves.
Figure 14B:
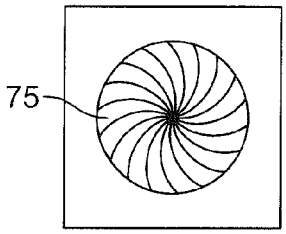
Figure 14C:
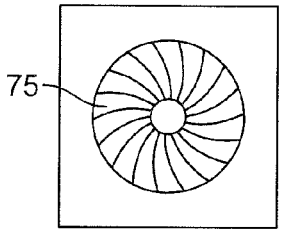

The inventive heater design is further unique in that it can be used for multiple type and shaped "restricted" inlets and can accommodate differently made and actuated valves. One type of valve is the baffle or flap valve shown in FIG. 3*a*. However, other valves could be used and FIG. 14*a*-14*i* shows different examples, although this listing is not intended to be an exhaustive list. FIG. 14*a* show a single plane iris action 75 valve in side view with FIG. 14*b* showing a front view of the valve in the closed position and FIG. 14*c* showing the valve 75 partially opened.

Figure 14D:
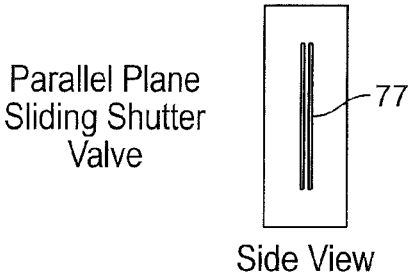
Figure 14E:
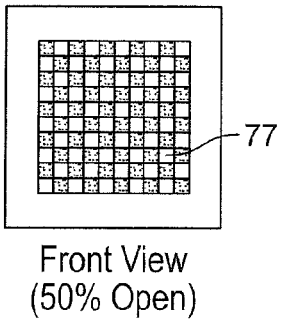
Figure 14F:
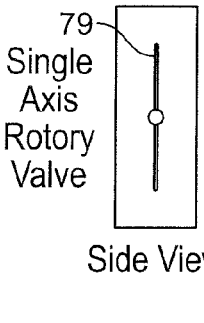
Figure 14G:
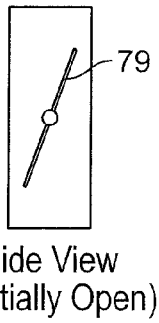

FIG. 14*d* shows a parallel plane sliding shutter valve 77 in side view with FIG. 14*e* showing the front view of the valve 77 in a 50% open position. FIG. 14*f* shows a side view of a single axis rotary valve 79 with FIG. 14*g* showing the valve 79 in a partially open position.

Figure 14H:
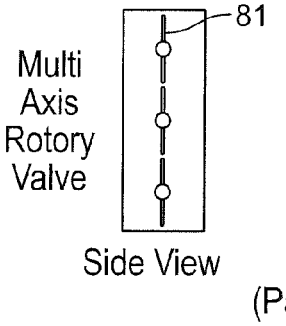
Figure 14I:
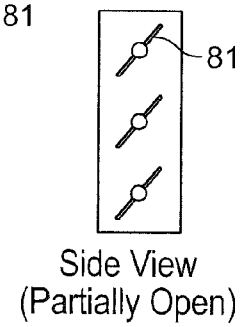

FIG. 14*h* shows a multi-axis rotary valve 81 in side view and FIG. 14*i* shows the valve 81 in a partially open position.

Turning back to the heater diffuser screen shown in FIG. 3*a* and FIG. 8*a* and this aspect of the invention, when considering the duct heater in combination with restricted inlets, the upstream cross-sectional area for the inlet is smaller when compared to the downstream cross-sectional area. This could create a situation where the air flow is not evenly distributed over the heater elements. That is, without even airflow over the heater face, hot spots can be expected in certain areas and this can cause over temperature issues with upstream components.

In the prior art, the typical method of controlling these problems is to vary the heating power produced in order to avoid creating hot spots.

In contrast to this approach for avoiding hot spots, the inventive heater design with the diffuser screen 68, see FIG. 8*a*, provides a mechanical means for controlling air flow over the heater and lowering hot spots. This screen is essential to the heater operation when being used in combination with equipment or structure such as the valve damper box shown in FIGS. 3*a* and 8*a*, for example.

The purpose of this diffuser screen is two fold. One purpose is to protect the equipment like the valve from excessive radiant heat from the duct heater itself. The other purpose is to more evenly distribute the air flow over the heater. The diffuser screen is not needed for duct heater application only.

This diffuser screen can take virtually any screen design provided that its opening area is in a range of from 51% to 67%. Going below the 51% open area percentage means that there is an insufficient passageway for air travel and an insufficient amount of air passes to the heater itself. This can result in the problem sought to be alleviated, hot spots, and create safety issues. Allowing too much air to pass over the heater elements, i.e., having a screen with an open area of more than 67%, adversely affects the heater element performance, e.g., radiant heat effects are compromised.

Additionally, these screens (used in the % open range mentioned) are placed over the entire face of the heater and act as the radiant shield, thus protecting the upstream components from excess radiant energy created under low airflow conditions.

Therefore, the new inventive heater does not limit the power produced by the heater for more even performance in adverse conditions, but uses the screens as an "Air Limiting/Metering Device" to even airflow and further provide a shield from the radiant energy, thus helping protect upstream components.

As such, an invention has been disclosed in terms of preferred embodiments thereof which fulfills each and every one of the objects of the present invention as set forth above and provides a new and improved duct heater and method of use.

Of course, various changes, modifications and alterations from the teachings of the present invention may be contemplated by those skilled in the art without departing from the intended spirit and scope thereof. It is intended that the present invention only be limited by the terms of the appended claims.

We claim:

1. In a duct heater adapted to fit within a duct carrying a fluid for heating purposes, the duct heater comprising open coil heater elements including backup and auto limits, the improvement comprising:

at least two backup limits and a single auto limit, the backup limits arranged symmetrically with respect to the auto limit with the auto limit positioned between the two back up limits so that functionality of the backup and auto limits is maintained regardless of the orientation of the heater and direction of fluid flow in the duct containing the duct heater.

2. The duct heater of claim 1, wherein the backup and auto limits are arranged vertically or horizontally on the heater.

3. The duct heater of claim 1, further comprising a diffuser screen covering an upstream face of the heater, the diffuser screen having openings therein, a total open area formed by the openings being 51-67% of the total area of the diffuser screen.

4. In a duct heater assembly comprising a duct heater adapted to fit within a duct carrying a fluid for heating purposes and a piece of equipment or structure located upstream of the duct heater, the improvement comprising using the duct heater of claim 1 and further comprising a diffuser screen covering an upstream face of the heater, the diffuser screen having openings therein, a total open area formed by the openings being 51-67% of the total area of the diffuser screen.

5. The assembly of claim 4, wherein the piece of equipment further comprises an inlet having width and height dimensions, the duct having width and height dimensions, a size of the duct based on the following formula:

x is a distance between each edge of the restricted inlet and each face of the width side of the duct measured vertically;

y is a distance between each edge of the restricted inlet and each face of the width side of the duct measured horizontally;

a range of $x_{min}$ to $x_{max}$ is 0.0 to 2.0 inches, a range of $y_{min}$ to $y_{max}$ is 0.0 to 8.0 inches; and a height range of the duct is 2x+a vertical height of the inlet, where x ranges between 0.0 and 2.0 and a width range of the duct is 2y+a vertical height of the inlet, where y ranges between 0.0 and 8.0.

6. The assembly of claim 4, wherein the equipment is a single duct variable air volume damper box with a valve.

7. The assembly of claim 6, wherein the valve is one or butterfly or rotary valve, iris valve, sliding shutter valve, multi-axis rotary valve.

8. The assembly of claim 4, wherein the restricted inlet is one having a circular, rectangular, square, oval, or obround shape.

9. A duct heater and duct combination, wherein the duct heater is the duct heater of claim 1, and wherein the duct is a horizontal duct or a vertical duct and the duct heater is adapted to be inserted on any side of the horizontal or vertical duct for heating purposes.

10. The duct heater of claim 1, wherein the duct heater is configured so that it can be inserted on any side of a horizontal duct or a vertical duct.

11. The duct heater assembly of claim 4, wherein the duct heater is configured so that it can be inserted on any side of a horizontal duct or a vertical duct.

12. The duct heater of claim 10, wherein the duct heater configuration allows the duct heater to be flipped vertically either side to side or end to end for use in a vertical or horizontal duct.

13. The duct heater of claim 11, wherein the duct heater configuration allows the duct heater to be flipped vertically either side to side or end to end for use in a vertical or horizontal duct.

* * * * *